US010301140B2

(12) United States Patent
Iwano et al.

(10) Patent No.: US 10,301,140 B2
(45) Date of Patent: May 28, 2019

(54) PRINTER

(71) Applicant: RISO KAGAKU CORPORATION, Minato-ku, Tokyo (JP)

(72) Inventors: Tsuyoshi Iwano, Tsukuba (JP); Masaru Ohmori, Tsukuba (JP); Yasuko Yamamoto, Tsukuba (JP); Keiichi Matsukawa, Tsukuba (JP); Masahiro Kato, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/876,324

(22) Filed: Jan. 22, 2018

(65) Prior Publication Data

US 2018/0244486 A1 Aug. 30, 2018

(30) Foreign Application Priority Data

Feb. 27, 2017 (JP) ..... 2017-034904

(51) Int. Cl.

| | |
|---|---|
| ***B65H 31/26*** | (2006.01) |
| ***B65H 31/02*** | (2006.01) |
| ***G03G 21/20*** | (2006.01) |
| ***G03G 15/00*** | (2006.01) |

(52) U.S. Cl.

CPC ..... *B65H 31/26* (2013.01); *B65H 31/02* (2013.01); *G03G 15/6552* (2013.01); *G03G 21/206* (2013.01); *B65H 2301/4212* (2013.01); *B65H 2405/1111* (2013.01); *B65H 2405/11151* (2013.01); *B65H 2406/351* (2013.01); *B65H 2406/3511* (2013.01); *B65H 2406/362* (2013.01); *B65H 2511/10* (2013.01); *B65H 2511/152* (2013.01); *B65H 2511/214* (2013.01); *B65H 2515/112* (2013.01); *B65H 2515/212* (2013.01); *B65H 2601/211* (2013.01); *B65H 2801/06* (2013.01)

(58) Field of Classification Search

CPC ..... G03G 21/206; G03G 2221/1645; B65H 29/241; B65H 31/16; B65H 31/26; B65H 2406/351; B65H 2406/36; B65H 2406/3662

USPC ..... 399/92

See application file for complete search history.

(56) References Cited

U.S. PATENT DOCUMENTS

2012/0087693 A1* 4/2012 Yamaguchi ..... G03G 21/206 399/92

FOREIGN PATENT DOCUMENTS

| | | |
|---|---|---|
| JP | 05089355 U | 12/1993 |
| JP | 05319666 A | 12/1993 |
| JP | 10059608 A | 3/1998 |

* cited by examiner

*Primary Examiner* — David H Bollinger
(74) *Attorney, Agent, or Firm* — Holtz, Holtz & Volek PC

(57) ABSTRACT

A printer includes: a housing; a paper delivery table on which paper sheets delivered from an inside of the housing are stacked; a suction fan that sucks a gas that cools down the inside of the housing from an outside of the housing; and a first suction port that is a suction port through which a gas is sucked from the outside of the housing by the suction fan and through which a gas below a paper sheet that is delivered from the inside of the housing is sucked.

3 Claims, 4 Drawing Sheets

PRINTER

CROSS-REFERENCE TO RELATED APPLICATION

This application is based upon and claims the benefit of priority of the prior Japanese Patent Application No. 2017-034904, filed on Feb. 27, 2017, the entire contents of which are incorporated herein by reference.

FIELD

The embodiments discussed herein are related to a printer including a paper delivery table on which paper sheets are stacked.

BACKGROUND

Conventionally, a technology has been proposed for releasing the air below a paper sheet delivered from a printer by providing an opening in a fence that surrounds the delivered paper sheet in a paper delivery table (see, for example, Japanese Laid-Open Utility Model No. 5-89355 and Japanese Laid-Open Patent Publication No. 10-59608).

In addition, a paper delivery table has also been proposed that forcibly sucks air from an opening of a fence by using suction means (see, for example, Japanese Laid-Open Patent Publication No. 5-319666).

SUMMARY

In one aspect, a printer includes: a housing; a paper delivery table on which paper sheets delivered from an inside of the housing are stacked; a suction fan that sucks a gas that cools down the inside of the housing from an outside of the housing; and a first suction port that is a suction port through which a gas is sucked from the outside of the housing by the suction fan and through which a gas below a paper sheet that is delivered from the inside of the housing is sucked.

The object and advantages of the invention will be realized by means of the elements and combinations particularly pointed out in the claims.

DESCRIPTION OF EMBODIMENTS

For paper sheets delivered from a printer, and in particular paper sheets having a small basis weight (weight per square meter), when an opening is only provided in a fence that surrounds a delivered paper sheet, as described above, the paper sheets may be misaligned on a paper delivery table due to the resistance of the air below a delivered paper sheet.

By forcibly sucking the air above the paper delivery table, as described above, the behavior of paper delivery can be stabilized. In addition, by forcibly sucking the air above the paper delivery table, the speed of a dropping of a delivered paper sheet increases, and this can also prevent collision of paper sheets due to the warping of the paper sheets, the erroneous detection of a fully stacked state of a detection mechanism for detecting a stacked volume on the paper delivery table, and the like, which are likely to occur in high-speed printing.

However, when a mechanism for forcibly sucking the air above the paper delivery table by using the suction means is provided, the suction means, piping that configures a gas flow path between the suction means and the paper delivery table, and the like need to be provided outside the printer, and the structure of the printer becomes complicated.

A printer 1 according to an embodiment of the present invention is described below with reference to the drawings.

Figure 1:
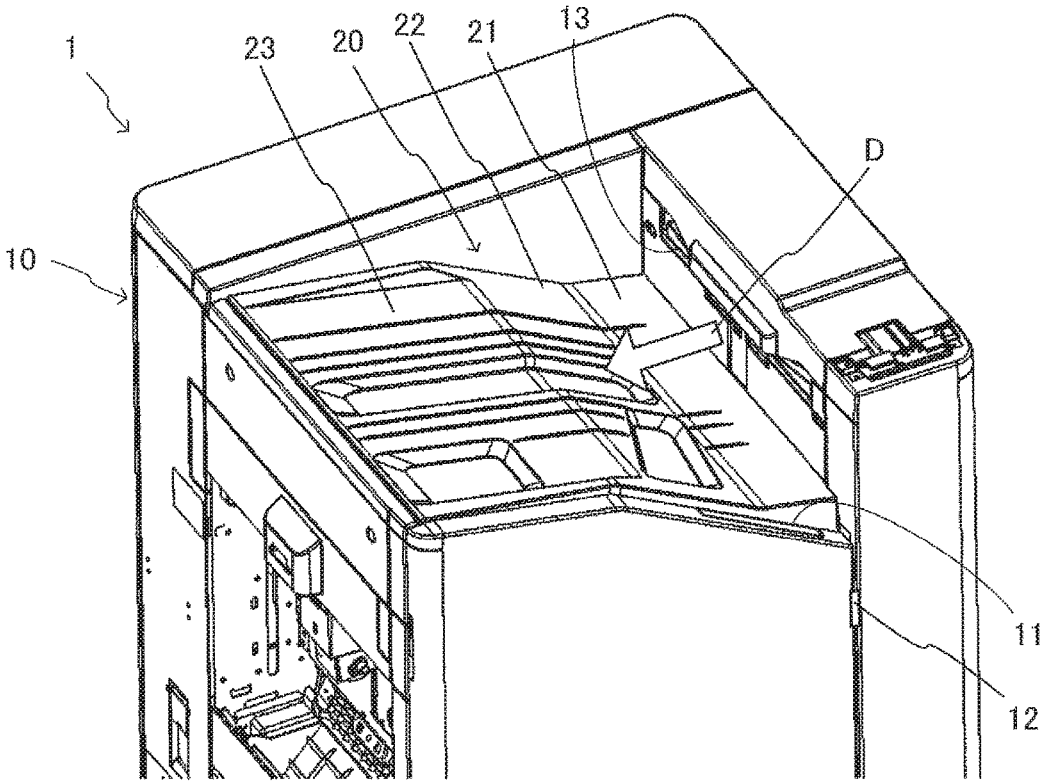
FIG. 1 is a perspective view illustrating a printer according to an embodiment.

FIG. 1 is a perspective view illustrating the printer 1.

Figure 2:
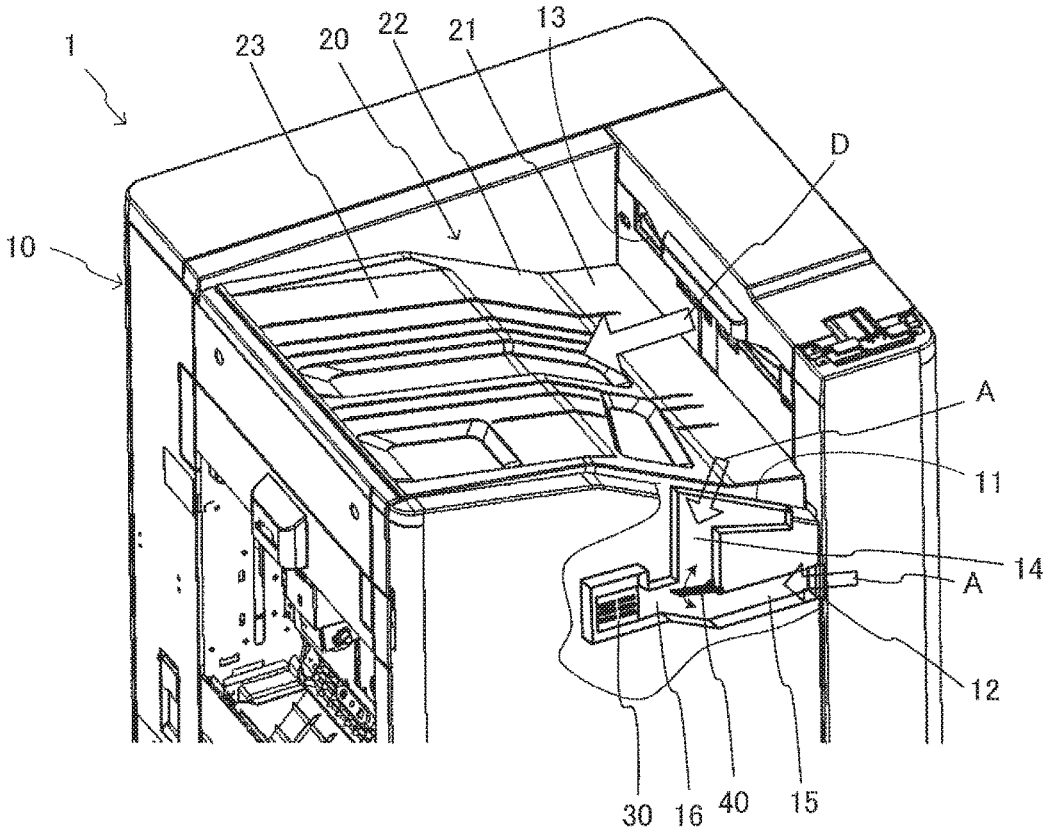
FIG. 2 is a perspective view that partially illustrates an internal structure of the printer according to the embodiment.

FIG. 2 is a perspective view that partially illustrates an internal structure of the printer 1.

Figure 3:
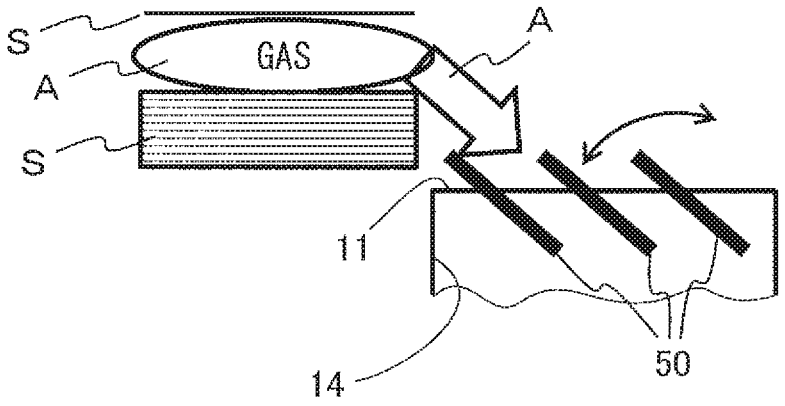
FIG. 3 is a diagram explaining a first suction port according to the embodiment.

FIG. 3 is a diagram explaining a first suction port 11.

The printer 1 includes a housing 10, a paper delivery table 20, a cooling fan 30, which is illustrated in FIG. 2 as an example of a suction mechanism (a suction fan), and a first suction port 11. In addition, the printer 1 may include a second suction port 12, the suction ratio adjustment valve 40 illustrated in FIG. 2, and the suction direction adjustment plates 50 illustrated in FIG. 3.

The paper delivery table 20 is provided in a position that is recessed downward from the top face of the housing 10 above the housing 10. Paper sheets S (see FIG. 3) that are delivered in a delivery direction D from a delivery port 13 of the housing 10 are stacked on the paper delivery table 20. The paper delivery table 20 is provided integrally with the housing 10 so as to configure a portion of an upper face of the housing 10, but the paper delivery table 20 may be arranged separately from the housing 10, for example, above the housing 10 or beside the housing 10.

On a stacking face (an upper face) of the paper delivery table 20, a first slope 21 on a side of the delivery port 13, a second slope 22 at the center, and a third slope 23 on a side opposite to the delivery port 13 are continuously provided in the delivery direction D of the paper sheet S. The first slope 21, the second slope 22, and the third slope 23 are inclined so as to be higher in a position farther from the delivery port 13 in the delivery direction D of the paper sheet S. Therefore, paper sheets S delivered from the delivery port 13 are stacked on the paper delivery table 20 in such a way that a rear-end side of the delivery direction D (the side of the delivery port 13) is low and a front-end side of the delivery direction D is high. The second slope 22 has a larger angle to the horizontal plane than the first slope 21 and the third slope 23. However, the first slope 21, the second slope 22, and the third slope 23 may not be sectioned, and as an example, the stacking face of the paper delivery table 20 may extend on the same plane.

In the housing 10, the first suction port 11 and the second suction port 12 are provided. As illustrated in FIG. 2, the first suction port 11 communicates with a first flow path 14 inside the housing 10, and the second suction port 12 communicates with a second flow path 15 inside the housing 10. The first flow path 14 and the second flow path 15 join a third flow path 16 inside the housing 10. The cooling fan 30, which is an example of the suction mechanism, cools down the inside of the housing 10 such as the printing unit 70 or the controller 61 described later by using gases A outside the housing 10 that have been sucked from the first suction port 11 and the second suction port 12 and have entered the third flow path 16 via the first flow path 14 and the second flow path 15. The cooling fan 30 is arranged on an inner side with respect to the third flow path 16 in a direction in which the gas A flows inside the housing 10, but the cooling fan 30 may be arranged in the middle of the third flow path 16. In addition, the first suction port 11 is provided in the housing 10, but may be provided in a member that is independent of the housing 10. In this case, flow paths such as the first flow path 14 or the third flow path 16 are provided outside the housing 10. When the first flow path 14 and the third flow path 16 are provided outside the housing 10, the structure becomes complicated, and therefore it is preferable that the first suction port 11 be provided in the housing 10.

The first suction port 11 is provided in a position that is recessed downward from the paper delivery table 20 just beside the paper delivery table 20 (on a front side in FIG. 1 and FIG. 2) so as to be opened upward. As described above, it is preferable that the first suction port 11 be provided below the stacking face (the first slope 21, the second slope 22, and the third slope 23) of the paper delivery table 20. However, the first suction port 11 may be provided above the paper delivery table 20.

The first suction port 11 is provided so as to suck the gas A below a delivered paper sheet S (a paper sheet S located at the top in FIG. 3), as illustrated in FIG. 3. In order to suck the gas A below the paper sheet S, as described above, it is preferable that the first suction port 11 be provided around the paper delivery table 20.

As illustrated in FIG. 1 and FIG. 2, the first suction port 11 (an opening face) has a rectangular shape in which the delivery direction D of the paper sheet S delivered from the delivery port 13 is a longitudinal direction. The first suction port 11 is provided parallel to the second slope 22, and it can be said that the first suction port 11 is inclined in the same direction as the direction of the stacking face of the paper delivery table 20 with respect to the horizontal plane.

The position of the second suction port 12 is not particularly limited, but the second suction port 12 is provided, for example, in a position below the first suction port 11 so as to be opened laterally. The second suction port 12 may be omitted, and the gas A may only be sucked from the first suction port 11 by the cooling fan 30. However, in particular, when it is difficult to align delivered paper sheets S on the paper delivery table 20 due to an increase in a suction force from the first suction port 11, it is preferable that the second suction port 12 be provided.

The suction ratio adjustment valve 40 is provided movably (rotatably) between the first and second flow paths 14 and 15 and the third flow path 16 in order to adjust a ratio of a flow rate of a gas A that is sucked from the first suction port 11 and passes through the first flow path 14 to a flow rate of a gas A that is sucked from the second suction port 12 and passes through the second flow path 15. As an example, the suction ratio adjustment valve 40 includes a plate-like member that selectively blocks a flow path between the first flow path 14 and the third flow path 16 or a flow path between the second flow path 15 and the third flow path 16, and a hinge that rotatably holds the plate-like member.

As an example, when the suction ratio adjustment valve 40 rotationally moves in a direction in which the flow path between the first flow path 14 and the third flow path 16 is narrowed, a flow rate of a gas A that flows from the first flow path 14 to the third flow path 16 decreases, whereas a flow rate of a gas A that flows from the second flow path 15 to the third flow path 16 increases. Stated another way, the opening areas of the first suction port 11 and the second suction port 12 are invariable, and therefore when a suction force of the cooling fan 30 is constant, the total flow rate of a gas A that flows to the third flow path 16 remains constant, and the cooling performance of the inside of the housing 10 is not affected even when the suction ratio adjustment valve 40 rotationally moves.

As illustrated in FIG. 3, three suction direction adjustment plates 50 are arranged, for example, in the first suction port 11. The suction direction adjustment plates 50 are flaps that are provided movably (rotatably) so as to adjust a suction direction of a gas A that is sucked from the first suction port 11. The material of the suction direction adjustment plate 50 is not particularly limited, but the suction direction adjustment plate 50 may be, for example, a thin resinous member or any member that can change a suction direction of a sucked gas A. As an example, each of the suction direction adjustment plates 50 is arranged together with a rotary shaft that rotationally moves the suction direction adjustment plate 50.

Figure 4:
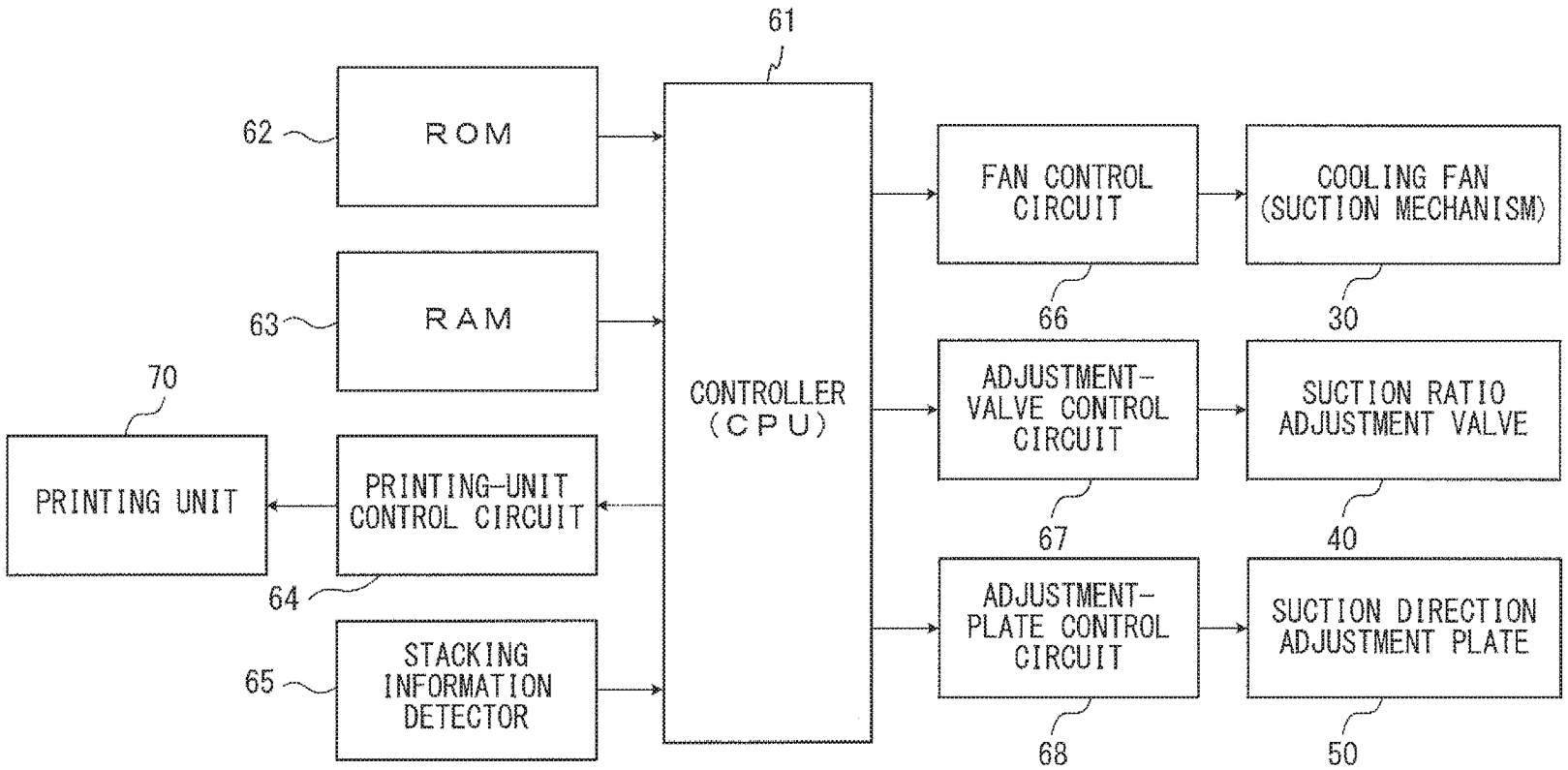
FIG. 4 is a control block diagram of the printer according to the embodiment.

FIG. 4 is a control block diagram of the printer 1.

The controller 61 illustrated in FIG. 4 is a processor, such as a central processing unit (CPU), that functions as a computing device that controls the operation of the entirety of the printer 1. The controller 61 reads and executes a control program for the printer 1.

A read-only memory (ROM) 62 is, for example, a read-only semiconductor memory in which a prescribed control program is recorded in advance. As the ROM 62, a memory in which stored data is non-volatile when a power supply is stopped, such as a flash memory, may be used.

A random access memory (RAM) 63 is, for example, a random access semiconductor memory that is used as a working storage area as needed when the controller 61 executes various control programs.

The controller 61 controls a motor or the like that drives the printing unit 70, the cooling fan 30, the suction ratio adjustment valve 40, and the suction direction adjustment plates 50 by outputting a control signal to a printing-unit control circuit 64, a fan control circuit (a suction-mechanism control circuit) 66, an adjustment-valve control circuit 67, and an adjustment-plate control circuit 68.

Examples of the printing unit 70 include a stencil printing unit and an inkjet printing unit, but a printing method is not particularly limited.

A stacking information detector 65 detects stacking information, such as the height of stacking (the number of delivered paper sheets or a thickness), a size, a basis weight, or the quality of paper, of a paper sheet S stacked on the paper delivery table 20. As an example, the height of stacking or the size may be detected by obtaining printing information that is used for the printing unit 70 to perform printing, or may be detected by detecting a paper sheet S on the paper delivery table 20 using a photodetector, an imaging device, or the like. Information relating to the basis weight or the quality of paper may be appropriately received from a user of the printer 1, or the basis weight or the quality of paper may be detected by using a conveyance resistance or the like of a paper sheet S.

The controller 61 adjusts a ratio of a flow rate of a gas A that is sucked from the first suction port 11 to a flow rate of a gas A that is sucked from the second suction port 12 by controlling the position of the suction ratio adjustment valve 40 in accordance with the stacking information above. By doing this, the flow rate of the gas A that is sucked from the first suction port 11 can be set to a desired flow rate. As an example, it is preferable that the suction ratio adjustment valve 40 be controlled by the controller 61 so as to suck gas in the case of a paper sheet S having a small basis weight.

This is because a paper sheet S having a large basis weight receives a small influence of air resistance and the behavior of paper delivery is stable, whereas the behavior of paper delivery of a paper sheet S having a small basis weight is not stable regardless of the size of the paper sheet. The position of the suction ratio adjustment valve 40 may be able to be adjusted manually or under the control of the controller 61 according to a user's settings.

In addition, the controller 61 adjusts the suction direction of a gas A that is sucked from the first suction port 11 by controlling the positions of the suction direction adjustment plates 50 in accordance with the stacking information (in particular, the height of stacking). The positions of the suction direction adjustment plates 50 may be able to be adjusted manually or under the control of the controller 61 according to a user's settings, similarly to the suction ratio adjustment valve 40.

In the embodiment described above, the printer 1 includes the housing 10, the paper delivery table 20, and the cooling fan 30, which is an example of the suction mechanism (the suction fan). On the paper delivery table 20, paper sheets S delivered from the inside of the housing 10 are stacked. The cooling fan 30 sucks a gas A that cools down the inside of the housing 10 from the outside of the housing 10. The first suction port 11 is a suction port through which a gas A is sucked from the outside of the housing 10 by the cooling fan 30, and is a suction port through which a gas A below a paper sheet S delivered from the inside of the housing 10 is sucked.

As described above, a gas A below a paper sheet S is sucked from the first suction port 11 by the cooling fan 30 that sucks a gas A that cools down the inside of the housing 10, and therefore the gas A below the delivered paper sheet S can be sucked in a simple configuration. By doing this, the behavior of the delivered paper sheet S can also be stabilized.

In addition, in the embodiment, the inside of the housing 10 is the printing unit 70 that prints on a paper sheet S. Therefore, the configuration can be made simpler by being used as both a cooling mechanism of the printing unit 70 and a suction mechanism that sucks a gas below the paper sheet S.

Further, in the embodiment, the first suction port 11 is provided in the housing 10. Therefore, the first flow path 14 and the third flow path 16 between the first suction port 11 and the cooling fan 30 can be prevented from being provided outside the housing 10, and this can make the configuration further simpler.

Furthermore, in the embodiment, the second suction port 12 is a suction port of a gas A that is sucked from the outside of the housing 10 by the cooling fan 30, and is a suction port that is provided in a position that is different from the position of the first suction port 11. In addition, the suction ratio adjustment valve 40 is a valve used to adjust a ratio of a flow rate of a gas A that is sucked from the first suction port 11 to a flow rate of a gas A that is sucked from the second suction port 12. Therefore, a suction force of a gas A below a delivered paper sheet S can be adjusted in a simple configuration using the suction ratio adjustment valve 40.

The present invention is not limited to the embodiment above with no change, and in an implementing stage, components can be varied and embodied without departing from the gist of the embodiment above. Various inventions can be made by appropriately combining a plurality of components disclosed in the embodiment above. As an example, all of the components disclosed in the embodiment may be combined appropriately. It goes without saying that various variations or applications can be made without departing from the spirit of the invention.

What is claimed is:

1. A printer comprising:

a housing;

a paper delivery table on which paper sheets delivered from an inside of the housing are stacked;

a suction fan that sucks a gas that cools down the inside of the housing from an outside of the housing;

a first suction port that is a suction port through which a gas is sucked from the outside of the housing by the suction fan and through which a gas below a paper sheet that is delivered from the inside of the housing is sucked;

a second suction port that is a suction port of a gas that is sucked from the outside of the housing by the suction fan, the second suction port being provided in a position that is different from a position of the first suction port; and a suction ratio adjustment valve that adjusts a ratio of a flow rate of a gas that is sucked from the first suction port and a flow rate of a gas that is sucked from the second suction port.

2. The printer according to claim 1, wherein the inside of the housing comprises a printing unit that prints on the paper sheet.

3. A printer comprising:

a housing;

a paper deliver table on which paper sheets delivered from an inside of the housing are stacked;

a suction fan that sucks a gas that cools down the inside of the housing from an outside of the housing;

a first suction port that is a suction port through which a gas is sucked from the outside of the housing by the suction fan and through which a gas below a paper sheet that is delivered from the inside of the housing is sucked; and a suction direction adjustment plate provided movably so as to adjust a suction direction of a gas that is sucked from the first suction port.

* * * * *